US010618346B2

(12) United States Patent
Hannig et al.

(10) Patent No.: US 10,618,346 B2
(45) Date of Patent: Apr. 14, 2020

(54) METHOD FOR PRODUCING A DECORATED WALL OR FLOOR PANEL

(71) Applicant: Akzenta Paneele + Profile GMBH, Kaisersesch (DE)

(72) Inventors: Hans-Jürgen Hannig, Bergisch Gladbach (DE); Egon Hoff, Mastershausen (DE)

(73) Assignee: Akzenta Paneele + Profile GMBH, Kaisersesch (DE)

( * ) Notice: Subject to any disclaimer, the term of this patent is extended or adjusted under 35 U.S.C. 154(b) by 0 days.

(21) Appl. No.: 15/506,138

(22) PCT Filed: Aug. 10, 2016

(86) PCT No.: PCT/EP2016/069063
§ 371 (c)(1),
(2) Date: Feb. 23, 2017

(87) PCT Pub. No.: WO2017/029172
PCT Pub. Date: Feb. 23, 2017

(65) Prior Publication Data

US 2018/0147882 A1 May 31, 2018

(30) Foreign Application Priority Data

Aug. 19, 2015 (EP) ..... 15181523

(51) Int. Cl.
*B27M 3/04* (2006.01)
*B27N 3/24* (2006.01)
(Continued)

(52) U.S. Cl.
CPC ..... *B44C 5/0461* (2013.01); *B27M 3/04* (2013.01); *B27N 3/002* (2013.01); *B27N 3/24* (2013.01);
(Continued)

(58) Field of Classification Search
CPC . B27M 3/04; B27N 3/002; B27N 3/24; B27N 7/005; B44C 5/04; B44C 5/0461; E04F 13/18; E04F 15/10
(Continued)

(56) References Cited

U.S. PATENT DOCUMENTS 2,993,523 A 7/1961 Monaco
5,529,812 A 6/1996 Keding
(Continued)

FOREIGN PATENT DOCUMENTS

CN 86105159 A 2/1987
DE 2113763 A1 9/1972
(Continued)

OTHER PUBLICATIONS

Herman Van Dyk, Determination of Wood Panel Uniformity by Means of Optical Sensor Technology, 2010 (Year: 2010).

*Primary Examiner* — Alexander M Weddle
(74) *Attorney, Agent, or Firm* — Harness, Dickey & Pierce, P.L.C.

(57) ABSTRACT

A method for producing a decorated wall or floor panel, comprises the steps of: providing a pourable carrier material, in particular a granulate; placing the carrier material between two belt-like conveying means; forming the carrier material under the influence of temperature to form a web-shaped carrier; compressing the carrier; treating the carrier under the influence of pressure with use of a twin belt press at a first temperature T1 while forming a first compression factor K1 of the carrier; treating the carrier under the influence of pressure at a second temperature T2 while forming a second compression factor K2 of the carrier, wherein T2<T1 and wherein K2<K1; optionally cooling the carrier; optionally applying a decorative subsurface onto at least part of the carrier; applying a decorative template onto
(Continued)

Figure 1:
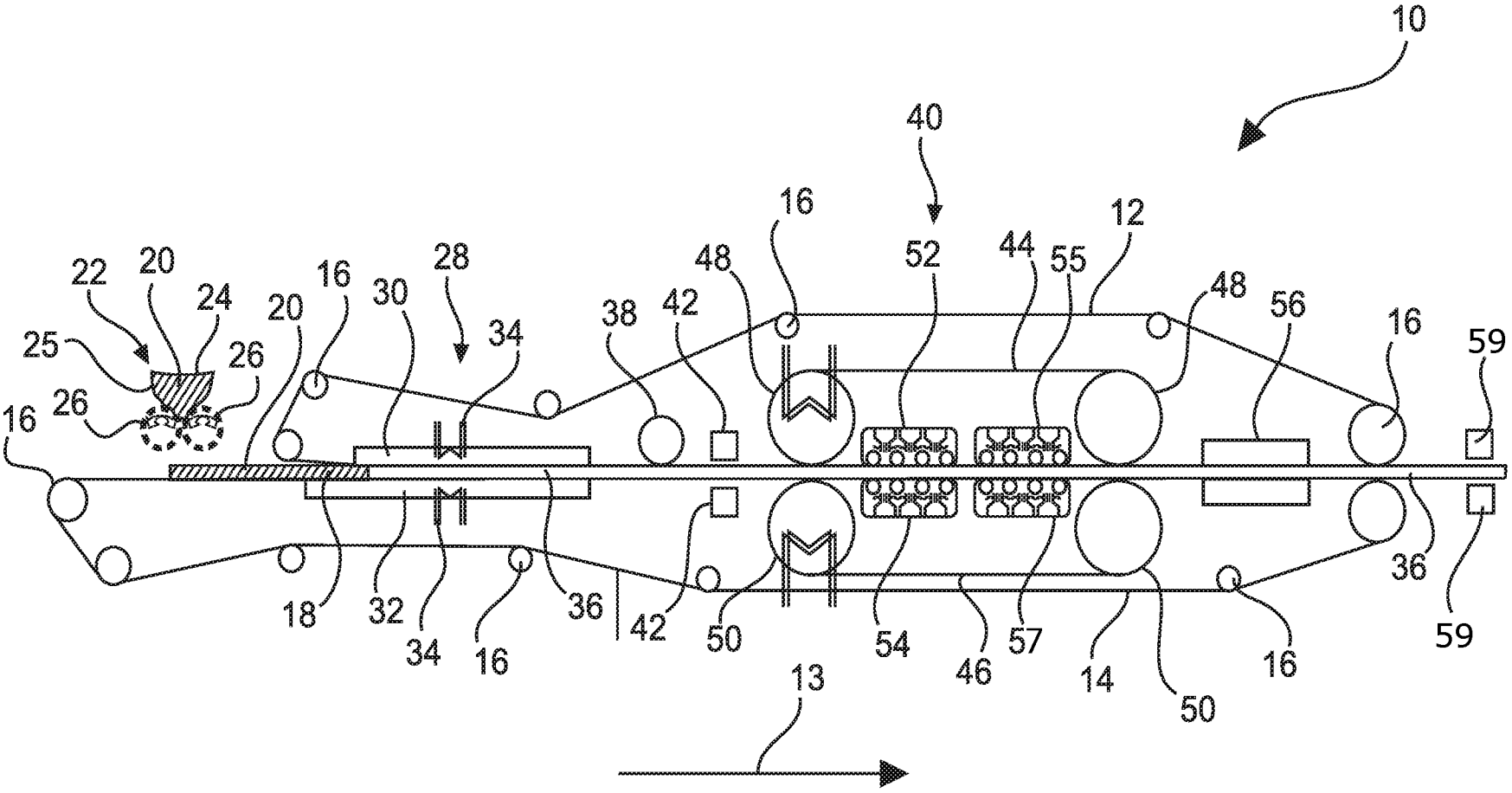

at least part of the carrier; and applying a protective layer onto at least part of the decoration.

15 Claims, 3 Drawing Sheets

(51) Int. Cl.

| | |
|---|---|
| ***B44C 5/04*** | (2006.01) |
| ***E04F 13/18*** | (2006.01) |
| ***E04F 15/10*** | (2006.01) |
| ***B27N 7/00*** | (2006.01) |
| ***B27N 3/00*** | (2006.01) |
| ***B30B 5/06*** | (2006.01) |

(52) U.S. Cl.
CPC ..... *B27N 7/005* (2013.01); *B30B 5/06* (2013.01); *B44C 5/04* (2013.01); *E04F 13/18* (2013.01); *E04F 15/10* (2013.01)

(58) Field of Classification Search
USPC ..... 264/119
See application file for complete search history.

(56) References Cited

U.S. PATENT DOCUMENTS

| | | | |
|---|---|---|---|
| 6,569,272 | B2 | 5/2003 | Tychsen |
| 8,110,132 | B2 | 2/2012 | Kimberly |
| 2003/0138618 | A1 | 7/2003 | Courtoy et al. |
| 2003/0207083 | A1 | 11/2003 | Hansson et al. |
| 2004/0094262 | A1 | 5/2004 | Canti |
| 2006/0230358 | A1 | 10/2006 | Sacher et al. |
| 2007/0175912 | A1 | 8/2007 | Uehara et al. |
| 2008/0311299 | A1 | 12/2008 | Furukawa |
| 2009/0145066 | A1 | 6/2009 | Pervan et al. |
| 2009/0202810 | A1 | 8/2009 | Kimberly |
| 2010/0055420 | A1 | 3/2010 | Vermeulen |
| 2012/0183784 | A1 | 7/2012 | Russell |
| 2016/0016744 | A1 | 1/2016 | Turke et al. |
| 2016/0136913 | A1* | 5/2016 | Hannig ..... E04F 15/04 52/588.1 |

FOREIGN PATENT DOCUMENTS

| | | | | |
|---|---|---|---|---|
| DE | 19842510 | A1 | 3/2000 | |
| DE | 10205894 | A1 | 8/2003 | |
| EP | 1153747 | A2 | 11/2001 | |
| EP | 1842661 | A1 | 10/2007 | |
| EP | 1905600 | A2 | 4/2008 | |
| EP | 2402174 | A1 | 1/2012 | |
| GB | 2324982 | A | 11/1998 | |
| JP | H04235158 | A | 8/1992 | |
| JP | H09-216209 | A | 8/1997 | |
| JP | H09290409 | A | 11/1997 | |
| JP | H10-166321 | A | 6/1998 | |
| JP | H11-333983 | A | 12/1999 | |
| JP | 2001246606 | A | 9/2001 | |
| JP | 2009154037 | A | 7/2009 | |
| JP | 2010-162784 | A | 7/2010 | |
| JP | 2011522138 | A | 7/2011 | |
| WO | WO-2001/48333 | A1 | 7/2001 | |
| WO | WO-2002/28665 | A1 | 4/2002 | |
| WO | WO-2002/076697 | A1 | 10/2002 | |
| WO | WO-2002/094523 | A1 | 11/2002 | |
| WO | WO-2007/061193 | A1 | 5/2007 | |
| WO | WO-2008/061791 | A1 | 5/2008 | |
| WO | 2008122668 | A1 | 10/2008 | |
| WO | WO-2009/065769 | A2 | 5/2009 | |
| WO | WO-2015/011049 | A1 | 1/2015 | |
| WO | WO-2015011049 | A1 * | 1/2015 | ..... E04F 15/04 |

* cited by examiner

METHOD FOR PRODUCING A DECORATED WALL OR FLOOR PANEL

CROSS-REFERENCE TO RELATED APPLICATIONS

This application is a National Stage of International Application No. PCT/EP2016/069063, filed on Aug. 10, 2016, which claims the priority to European Patent Application 15181523.0, filed on Aug. 19, 2015. The entire disclosures of the above applications are incorporated herein by reference.

FIELD

The present disclosure relates to a method for producing a decorated wall or floor panel and an apparatus for implementing such a method.

BACKGROUND

This section provides background information related to the present disclosure which is not necessarily prior art.

Decorated plates are known per se, wherein the term wall panel also means panels, which are suitable for ceiling linings. They usually consist of a carrier or a core of a solid material such as a wood-based material, which on at least one side is provided with a decorative layer and a top layer and optionally with further layers, for example a wearing layer disposed between the decorative layer and the top layer. The decorative layer is usually a printed paper which is impregnated with a resin. The top layer and the other layers are usually made of resin, as well.

Herein, the production of the panels such as the core or the carrier possibly offers further room for improvements.

SUMMARY

This section provides a general summary of the disclosure, and is not a comprehensive disclosure of its full scope or all of its features.

It is therefore the object of the present invention to provide an improved method for producing decorated wall or floor panels.

The disclosure thus proposes a method for producing a decorated wall or floor panel, comprising the steps of:

a) providing a pourable carrier material, in particular a granulate,
b) placing the carrier material between two belt-like conveying means,
c) forming the carrier material under the influence of temperature to form a web-shaped carrier,
d) compressing the carrier,
e) treating the carrier under the influence of pressure with use of a twin belt press at a temperature T1 while forming a compression factor K1 of the carrier,
f) treating the carrier under the influence of pressure at a temperature T2 while forming a compression factor K2 of the carrier, wherein $T2<T1$ and wherein $K2<K1$,
g) optionally cooling the carrier,
h) optionally applying a decorative subsurface onto at least a portion of the carrier,
i) applying a decoration reproducing a decorative template onto at least a portion of the carrier,
j) applying a protective layer onto at least a portion of the decoration.

The term "decorated wall or floor panel" or "decorative panel" in the sense of the disclosure means in particular wall, ceiling, door or floor panels comprising a decoration reproducing a decorative template applied onto a carrier plate. Decorative panels are used in a variety of ways both in the field of interior design of rooms and for decorative claddings of buildings, for example in exhibition stand construction. One of the most common application fields of decorative panels is their use as a floor covering. Herein, the decorative panels often comprise a decoration intended to replicate a natural material.

Examples of such replicated natural materials or decorative templates are wood species such as maple, oak, birch, cherry, ash, walnut, chestnut, wenge or even exotic woods such as Panga, mahogany, bamboo and bubinga. In addition, often natural materials such as stone surfaces or ceramic surfaces are replicated.

Accordingly, a "decorative template" in the sense of the present disclosure may be understood as such an original natural material or at least a surface of such a material which is to be imitated or replicated by the decoration.

A "pourable" material can be understood in particular as a material which can be applied by a pouring process or a scattering process onto a subsurface. Herein, the material may be provided as a fluid or in particular as a pourable solid.

"Granules" or a "granular material" means a solid or a head of a solid which comprises or consists of a plurality of solid particles, such as grains or beads. By way of example but not limited thereto grainy or powdered materials may be mentioned here.

A "carrier" can in particular be understood as a layer serving as a core or as a base layer in a finished panel which in particular may comprise a natural material, such as a wood-based material, a fiber material or a material comprising a plastic. For example, the carrier may already impart or at least contribute to a suitable stability for the panel.

A "web-shaped carrier" may be understood as a carrier which in its manufacturing process has a web-shaped structure and thus a length which is considerably greater compared to its thickness or width, wherein its length may be, for example, greater than 15 meters.

The term "plate-shaped carrier" in the sense of the present disclosure may be understood as a carrier, which is formed from the web-shaped carrier by separation and is formed in the shape of a plate. The plate-shaped carrier may further already define the shape and/or size of the panel to be produced. However, the plate-shaped carrier can also be provided as a large plate. A large plate in the sense of the disclosure is in particular a carrier whose dimensions several times exceed the dimensions of the final decorative panels, and which in the course of the manufacturing process is separated into a corresponding plurality of decorative panels, for example by sawing, laser or water jet cutting. For example, the large plate may correspond to the web-shaped carrier.

"Wood-based materials" in the sense of the disclosure in addition to solid wood materials are materials such as cross-laminated timber, glue-laminated timber, block-board, veneered plywood, laminated veneer lumber, parallel strand lumber and bending plywood. In addition, wood-based materials in the sense of the disclosure are also chipboards such as pressboards, extruded boards, oriented structural boards (OSB) and laminated strand lumber as well as wood fiber materials such as wood fiber insulation boards (HFD), medium hard and hard fiberboards (MB, HFH) and in particular medium density fiberboards (MDF) and high density fiberboards (HDF). Even modern wood-based materials such as wood polymer materials (wood plastic composite, WPC), sandwich boards made of a lightweight core material such as foam, rigid foam or honeycomb paper and a layer of wood applied thereto, and minerally hardened, for example with cement, chipboards are wood-based materials in the sense of the disclosure. Moreover, cork represents a wood-based material in the sense of the disclosure.

In the sense of the disclosure the term "fiber materials" means materials such as paper and non-woven fabrics on the basis of plant, animal, mineral or even synthetic fibers as well as cardboards. Examples of fiber materials on the basis of plant fibers in addition to papers and non-woven fabrics made of cellulose fibers are boards made of biomass such as straw, maize straw, bamboo, leaves, algae extracts, hemp, cotton or oil palm fibers. Examples of animal fiber materials are keratin-based materials such as wool or horsehair. Examples of mineral fiber materials are mineral wool or glass wool.

It could surprisingly be shown that the method described above enables a particularly advantageous production in particular of a carrier of a wall or floor panel.

In particular, it has been found that the method described herein enables to achieve a particularly smooth and defined adjustable surface of the carrier which, for example for the further processing into a panel in particular in the application of a decoration, for example by direct printing, can be of particular advantage.

First, in accordance with the present method a carrier or a core is produced. To this end, the method described above comprises according to method step a) initially providing a pourable carrier material. The carrier material serves as a basis for the production of in particular plate-shaped carriers for panels. It may, for example, be provided as a homogeneous material or as a mixed material of two or more materials. The carrier material or at least a component of the carrier material should have an appropriate melting point or a softening point, which enables to form the carrier material in a further method step by the action of heat, as is explained in detail below. In a particularly advantageous manner the carrier material can be provided as a pourable solid or as granules, wherein the granules depending on the material used may have a particle size in the range of ≥100 μm to ≤10 mm by way of example only. This allows for easy storage and also enables a particularly good adaptability to a desired material composition. In particular in a granular form a particularly homogeneous mixture of different components may be produced, wherein a particularly defined mixture with an accurately adjustable composition can be obtained. By way of example so-called dry blends can be used, i.e. dry plastic powders with additives. In addition, granules in particular in the above described size range may be distributed very uniformly and also very defined on a subsurface such that a carrier with a highly defined property profile can be produced. Herein, a preferred deposition or distribution of the carrier material can have a deviation of the bulk density of ≤5%, in particular ≤3%.

According to method step b) the pourable, in particular granular carrier material is disposed between two belt-like conveying means. In detail, a lower belt-like conveying means is moved circumferentially and an upper belt-like conveying means is moved circumferentially at a defined distance from the lower conveying means. Thus, the carrier material can be applied onto the lower conveying means and subsequently be confined by the lower and the upper conveying means. By means of an exact scattering process a lateral boundary can be dispensed with. By means of the two conveying means the carrier material can be transferred to or through individual processing stations and processed into a carrier. Furthermore, the carrier material can already be pre-formed in this method step. Thus, the belt-like conveying means may have two functions, namely that of a transport means and that of a mold.

The belt-like conveying means at least in the region of the twin belt press may, as described below, at least partially be made of Teflon or polytetrafluoroethylene (PTFE). For example, the belts can be formed entirely of polytetrafluoroethylene, or belts may be used which are provided with an outer layer of polytetrafluoroethylene. In the latter case, for example, glass fiber reinforced plastic belts or steel belts comprising a coating of polytetrafluoroethylene can be used. By this kind of conveying means due to the anti-adhesion properties of this material a particularly defined, for example, smooth surface of the produced carrier may be obtained. Thus, it can be prevented that the conveyed carrier material adheres to the conveying means and thus adversely affects the surface structure directly or by adherent material in a next cycle. In addition polytetrafluorethylen even at high temperatures is resistant against chemicals as well as against decomposition, so that on the one hand a temperature treatment of the carrier material is possible without any problems and on the other hand the conveying means are also stable for a long period. In addition, the material may be freely selected.

Herein, the conveying means may pass the entire apparatus or may be interrupted and configured as a plurality of conveying means.

The application of the carrier material according to method step b) may in particular be realized by means of a plurality of scattering heads, which are adapted to dispense the carrier material in a defined way, for example from storage containers. As to the scattering heads these for example may be part of a scattering aggregate and include at least one rotating scattering roller. For example, a hopper may be provided which can dispense the material to be dispensed onto the scattering roller in a defined way. In this case, a doctor blade may further be provided which sweeps the material into recesses of the roller. Subsequently the material can be dispensed from the scattering roller by use of a rotating brush roll, such that it hits against a baffle and slides from there onto the conveying means. In order to control the scattering width further a scattering width adjustment may be provided. In this embodiment, a particularly homogeneous dispense of the carrier material may be realized, which accordingly leads to a homogeneous carrier of defined quality.

For example one scattering head or two, three or more scattering heads may be provided. As a result, the carrier can be tailored in a particularly simple way, for example by providing a desired mixture of materials. In this embodiment, the mixture can be easily adjusted during the manufacturing process or between two charges such that a particularly great variability can be ensured. In addition, by different equipping the individual scattering heads a mixture of the carrier material may be produced only immediately prior to the processing such that a mutually adverse effect of the various components and a resulting reduction in quality of the produced carrier can be prevented.

For example, a sensor for checking the placement of the carrier material between the two belt-like conveying means, for example with respect to the area density of the applied material or the homogeneity may be provided.

In a further step according to method step c) the carrier material arranged between the belt-like conveying means is formed under the influence of temperature or heat. In this method step due to thermal energy or heat the carrier material or at least a part thereof is melted or softened, whereby, for example, the granules may become moldable. In this state it may homogeneously fill the receiving space formed between the conveying means and thus form a web-shaped carrier, which can be further treated.

The thus formed web-shaped carrier can be compressed simultaneously with or subsequently to method step c) according method step d). This method step may be implemented in particular in a suitable press or roller. Thus, here a first compression of the web-shaped carrier takes place. In this step, the carrier substantially can already obtain a desired thickness such that in following processing steps only a slight compression needs to be carried out and thus the further steps may be implemented very gently, as will be explained in detail below. Herein, in particular, it can be ensured that the temperature of the carrier is cooled down sufficiently such that a suitable compressibility is enabled while achieving the desired result.

In a further method step e) now a further treatment of the carrier under the influence of pressure with use of a twin belt press is implemented. In this method step, in particular the surface properties of the carrier can be adjusted or the thickness of the carrier can at least substantially be pre-adjusted. To this end, the previously compressed carrier can be treated under the influence of pressure, wherein in particular a low pressure can be selected such that this compression takes place only in a very small range. Thus, the design of the processing device in this method step can be selected in particular depending on a desired adjustment of the surface properties, which may be particularly gently and effective.

Here, in particular the use of a twin belt press can be advantageous, since with such a press particularly gentle compression steps are possible and moreover the surface quality or the thickness of the carrier can be set particularly effective and defined. Furthermore, in particular the use of a belt press enables high line speeds such that the whole process enables a particular high throughput.

For example, such a belt press, which usually has a fairly long processing room in the conveying direction of the carrier, may comprise a plurality of tempering zones, which allows a temperature profile and, therefore, an effective adjustment of the surface properties even at high line speeds, as is described in detail in the following.

In addition, by providing pneumatic cylinders a particularly uniform and defined adjustable belt tension of the twin belt press is enabled such that the adjustment of the surface quality as well as the compression may be extremely accurate. The belt press can include steel belts, for example, without a coating or with a polytetrafluorethylene coating, and/or may be temperature controlled for example by means of a thermal oil heater.

A smoothing or adjustment of the surface quality in this step can mean that while the top surface is smoothed already introduced structures or pores, if any, are not affected or are only affected in a defined area such that they are present in a desired extent even after that step, if desired. This can in particular be enabled by the use of a belt press with a suitable temperature profile and with suitable pressure values or by means of a calender, as is described in detail in the following.

In particular in heating the carrier or the carrier material in previous method steps it may preferably be provided that the carrier during or prior to method step e) is cooled, in particular below the melting point or softening point of a plastic component of the carrier material. In other words, the carrier can be cooled upstream or within the twin belt press. Herein, a cooling process may be implemented only within a restricted area such that the carrier actually has an increased temperature compared to room temperature (22° C.), however is below the previously set increased temperature and, thus, preferably and depending on the plastic material used below the melting point or the softening point of the plastic component included in the carrier material. This, for example, may be realized by an appropriate selection of the temperature of the tempering means which is disposed in the twin belt press, or the carrier may in particular be cooled or heated to a lower extent by tempering means located upstream of the twin belt press. In particular, by cooling the carrier a particular high quality surface image can be produced since the belts of the twin belt press which for example may be made of polytetrafluorethylene (Teflon) experience less stress. Moreover, cupping or the presence of blowholes or pores can be avoided such that the surface of the carrier can be of particularly high quality. Suitable temperatures for polyethylene, for example, are in the range of below 130° C., in particular below 120° C., such as in a range of ≥80° C. to ≤115° C., without being restricted thereto.

The above-described treatment of the carrier in method step e) is carried out at a temperature T1. This temperature can, for example, be in a range from ≥150° C. to ≤190° C., for example from ≥160° C. to ≤180° C., such as 170° C. In particular, when the carrier includes a plastic component, the carrier in this temperature range is comparatively soft and therefore, in particular, moldable along its entire thickness such that a compression can be carried out particularly effective even when using low contact pressures of the twin belt press. This method step can thus serve in particular for adjusting or calibrating the thickness of the carrier.

Suitable but not limiting contact pressures in this method step, for example, are in a range from ≥10 kg/cm$^2$ to ≤40 kg/cm$^2$, in particular ≥20 kg/cm$^2$ to ≤30 kg/cm$^2$, depending on, for example, the exact temperature chosen, the material of the carrier and the desired compression factor.

Furthermore, process step e) is realized with the formation of a compression factor K1 of the carrier. A compression factor K can be understood, in particular, as a factor by which the thickness of the carrier is reduced during the treatment step. Thus, with an original thickness of the carrier prior to the treatment of 5 mm and a thickness of the carrier of 4 mm after the treatment a thickness of 80% in relation to the thickness before the treatment is provided, i.e. the thickness was reduced by 20%. Accordingly, a compression factor K1 of 0.2 is provided.

Exemplary compression factors for method step e) for example are in a range of >0, such as ≥0.1 to ≤0.3, for example ≥0.15 to ≤0.25, so that the thickness at the aforementioned compression factors, for example, decreases by a value which is in a range from ≥10% to ≤30%, in particular ≥15% to ≤25%, such as 20%.

Subsequently to the above-described method step e) in the method described herein according to method step f) a further treatment of the carrier under the action of pressure at a temperature T2 for forming a compression factor K2 of the carrier is implemented, wherein T2<T1 and wherein K2<K1. Herein, in particular the temperatures T1 and T2 refer to the temperature acting on the carrier, such that it is possible that the carrier does not or does not necessarily have the same temperature over its entire thickness.

This method step thus involves a further treatment of the carrier with the application of pressure, which, for example, but not limited thereto, may immediately follow method step e). In this method step a temperature T2 is used which is lower than the temperature T1. The temperatures T1 and T2 may be adjustable by use of separately acting, for example, different tempering means and/or tempering means separated from each other. Thus, the temperature T2 is preferably not adjusted merely by a cooling process implemented by omitting heating during the treatment of the carrier, but rather by the defined action of a respective tempering means, such as by active cooling by use of a respective tempering means. This allows to adjust the temperature in a particular defined way, which enables a defined treatment result and a good adaptability.

The temperature T2 during method step f) may, for example by use of a carrier which includes plastic component, enable that the viscosity of the carrier is lower or the carrier is harder than in the case of the temperature T1 used in method step e).

This method step f) thus, in particular, may enable that the carrier is no longer significantly compressed or reduced in thickness, but rather is adjusted with respect to its surface characteristics such that the carrier or its surface is mainly smoothened.

By way of example and in no way limiting in this method step a compression may be implemented which can be in a range of, in particular, >0%, which however may be limited to values in a range of ≤20%, wherein the carrier subsequently reaches a thickness of 80% with respect to its thickness prior to method step f). For example, the carrier can be compressed by a value which, for example, is in a range of ≥3% to ≤20%, such as 10%. Thus, the compression factor K2 is less than the compression factor K1. Exemplary compression factors are approximately in a range of >0 to ≤0.2 such as in a range of >0.03 to ≤0.15, e.g. ≥0.05 to ≤0.12, for example 0.1.

The contact pressures in this method step are selected in a suitable manner, in particular depending on the desired compression factor K2 to be achieved, the carrier material and the set temperature.

In the event that the carrier has a plastic component, in this method step f) a temperature can be set which is above the crystallization temperature of the plastic. In the case of linear polyethylene (LLDPE) as a component of the carrier, for example, heating to a temperature in a range from ≥100° C. to ≤150° C., for example 120° C., may be sufficient and appropriate. Basically, therefore, the temperature T2 can be set in such a way that it is in a range of from ≥100° C. to ≤150° C., for example 120° C.

In the further course in a further method step g) then optionally a further cooling process of the web-shaped carrier is carried out. The carrier may in particular be cooled down by providing a cooling means with defined cooling stages to a temperature corresponding to the room temperature or, for example, in a range of up to 20° C. thereabove. For example, a plurality of cooling zones may be present in order to enable a defined cooling of the carrier.

It may also be provided that carriers after method step f), in particular immediately after process step f) and/or for example prior to the application of further layers onto the carrier, are heated to a temperature which is above the crystallization temperature of a plastic material present in the carrier. Subsequently, the carrier can again be cooled below the crystallization temperature, for example to room temperature (22° C.). In particular, if the carrier after the treatment according to method step f) and in particular after a cooling of the carrier after method step f) is reheated to a temperature which is above the crystallization temperature of the plastic component of the carrier material, the characteristics of the carrier can further be improved. For example, the carrier may have improved stability characteristics, in particular with respect to its mechanical and/or thermal and/or chemical resistance. Thus, the quality of the carrier can be further improved.

In particular, this embodiment is applicable in the presence of semicrystalline and/or thermoplastic polymers in the carrier material such as polyethylene or polypropylene. Herein, the crystallization temperature in the sense of the present invention is in particularly the temperature to which the polymer has to be heated in order to enable the formation of crystals during cooling. In particular, the crystallization upon cooling of the polymer starts at a temperature which may be below the melting temperature and optionally above the glass transition temperature. Accordingly, heating to a temperature below the melting temperature of the respective plastic or to a temperature below the melting temperature may be sufficient. In the case of linear polyethylene (LLDPE), for example, heating to a temperature in a range of ≥100° C. to ≤150° C., for example 120° C., may be sufficient. In the case of polypropylene, for example, heating to a temperature in a range of ≥160° C. to ≤200° C., for example 180° C., may be sufficient.

The duration of the corresponding heating, thus, in a way obvious to a person skilled in the art may depend on the feed speed of the carrier, its thickness, and the temperature to be set.

After cooling the carrier produced the carrier may be stored in a web-shaped form or as separated plate-shaped carriers and the process can momentarily be terminated. Preferably, however, further processing steps immediately follow which, for example, can be realized without grinding, in particular to process the provided carrier in order to produce a finished panel, as is explained in detail below.

For producing a finished panel, the method comprises the following further method steps in order to provide the carrier with a decoration and to coat this decoration with a protective layer. Herein, the subsequent steps are preferably carried out directly with the produced web-shaped carrier. However, the disclosure also includes that the web-shaped carrier is first divided into a plurality of plate-shaped carriers prior to an appropriate one of the method steps h) to j) and/or the plate-shaped carrier is treated further by the corresponding subsequent method steps. The following explanations apply for both alternatives accordingly, wherein in the following for simplification it is referred to a treatment of the carrier.

It is also possible, if appropriate, to carry out a pretreatment of the carrier for electrostatic discharge for example prior to method step h) or i) and optionally a subsequent electrostatic charging. This may in particular serve to avoid the occurrence of blurring in the course of the application of the decoration.

According to method step h) further optionally a decoration subsurface may be applied onto at least a portion of the carrier. For example, first a primer in particular for printing processes may be applied as a decoration subsurface for example in a thickness of ≥10 μm to ≤60 μm. In this case, as a primer a liquid radiation curable mixture based on a urethane or a urethane acrylate, optionally with one or more of a photoinitiator, a reactive diluent, a UV stabilizer, a rheological agent such as a thickener, radical scavengers, leveling agents, antifoams or preservatives, pigment, and/or a dye may be used.

In addition to the use of a primer it is possible to apply the decoration onto a decorative paper printable with a corresponding decoration, which may be provided for example by means of a resin layer as bonding agent previously applied to the carrier. Such a printing subsurface is suitable for flexographic printing, offset printing or screen printing processes and in particular for digital printing techniques such as inkjet processes or laser printing processes. For the application of the resin layer it may be preferably provided that a resin composition is applied which as a resin component includes at least one compound selected from the group consisting of melamine resin, formaldehyde resin, urea resin, phenol resin, epoxy resin, unsaturated polyester resin, diallyl phthalate or mixtures thereof. The resin composition may, for example, be applied at a coverage between ≥5 g/m$^2$ and ≤40 g/m$^2$, preferably ≥10 g/m$^2$ and ≤30 g/m$^2$. Further, a paper or a non-woven fabric with a grammage between ≥30 g/m$^2$ and ≤80 g/m$^2$, preferably between ≥40 g/m$^2$ and ≤70 g/m$^2$ may be applied onto the plate-shaped carrier.

Furthermore, according to method step i) a decoration reproducing a decorative template may be applied on at least a portion of the carrier. In this case, the decoration may be applied by so-called direct printing. The term "direct printing" in the sense of the invention means the application of a decoration directly onto the carrier of a panel or onto an unprinted fiber material layer applied to the carrier or a decoration subsurface. Here, different printing techniques such as flexographic printing, offset printing or screen printing may be used. In particular digital printing techniques such as inkjet processes or laser printing processes can be used.

The decorative layers may be formed of an in particular radiation curable paint and/or ink. For example, a UV-curable paint or ink can be used.

Here, the decorative layers can be applied respectively up to a thickness in a range of ≥5 μm to ≤10 μm.

It can also be provided to apply in addition to a positive image with regard to the color and/or texture also a corresponding negative image of the decorative template. In detail, as is known, for example, from positive staining or negative staining of wood-based materials the color impression for example of a grain can be reversed by the use of digital data, such that a negative is obtained with respect to the color or in particular lighter and darker areas. In addition to the color impression corresponding results can also be obtained for the applied structure, such that also with respect to the structural design a negative can be realized. Even such effects can be integrated easily based on digital three-dimensional data and without lead-time or refittings in a manufacturing process.

According to method step j) a protective layer can be applied onto at least a portion of the decoration. Such a layer for protecting the applied decoration can in particular be applied as a wearing or top layer on top of the decorative layer in a subsequent method step which in particular protects the decorative layer from wear or damage caused by dirt, moisture or mechanical impacts, such as abrasion. For example, it may be provided that the wearing and/or top layer is laid as a pre-produced overlay layer, such as based on melamine, onto the printed carrier and bonded to it by pressure and/or heat impact. Moreover, it may be preferred that for the formation of the wear and/or top layer also a radiation curable composition, such as a radiation curable lacquer, e.g. an acrylic lacquer, is applied. Herein, it may be provided that the wearing layer includes hard materials such as titanium nitride, titanium carbide, silicon nitride, silicon carbide, boron carbide, tungsten carbide, tantalum carbide, alumina (corundum), zirconia or mixtures thereof in order to increase the wear resistance of the layer. In this case, the application can be realized for example by means of rollers, such as rubber rollers, or pouring devices.

Furthermore, the top layer can be initially partially cured and subsequently a final coating process with a urethane acrylate and a final curing process, such as by use of a gallium emitter, may be carried out.

Moreover, the top and/or the wearing layer may include agents for reducing the static (electrostatic) charging of the final laminate. To this end, for example, it may be provided that the top and/or wearing layer comprise compounds such as choline chloride. The antistatic agent may, for example, be contained in a concentration between ≥0.1 wt.-% and ≤40.0 wt.-%, preferably between ≥1.0 wt.-% and ≤30.0 wt.-% in the composition for forming the top and/or wearing layer.

Moreover it can be provided that in the protective layer or in the wearing or top layer a structuring, in particular a surface structure matching with the decoration is formed by introducing pores. Herein, it may be provided that the carrier plate already has a structure and an alignment of a printing tool for applying the decoration and the carrier plate relative to each other is carried out depending on the structure of the carrier plate detected by optical methods. For aligning the printing tool and the carrier plate relative to each other it may be provided that a relative movement between the printing tool and the carrier plate necessary for the alignment process is carried out by a displacement of the carrier plate or by a displacement of the printing tool. Furthermore, it may be provided that a structuring of the decorative panels is implemented after the application of the top and/or wearing layer. For this purpose, it may be preferably provided that as a top and/or wearing layer a curable composition is applied and a curing process is carried out only to the extent that only a partial curing of the top and/or wearing layer occurs. In the thus partially cured layer a desired surface structure is embossed by means of suitable tools, such as a hard metal structure roller or a die. Herein, the embossing process is carried out in accordance with the applied decoration. In order to ensure a sufficient matching of the structure to be introduced with the decoration it may be provided that the carrier plate and the embossing tool are aligned relative to each other by corresponding relative movements. Subsequently to the introduction of the desired structure into the partially cured top and/or wearing layer a further curing process of the now structured top and/or wearing layer is carried out.

In many cases it is envisaged that in such a wearing or top layer a decorative surface structure coinciding with the decoration is introduced. A surface structure coinciding with the decoration means that the surface of the decorative panel has a haptically perceptual structure, which with respect to its shape and pattern corresponds to the applied decoration, in order to obtain a reproduction of a natural material as close to the original as possible even with respect to the haptic.

In addition, a backing layer can be applied onto the side opposite to the decorative side. Herein, it is particularly preferred that the backing layer is applied in a common calendering step together with the application of the paper or non-woven fabric onto the decorative side.

Alternatively or additionally the edge regions of the panel can be structured or provided with a profile in order to provide in particular releasable connecting elements. In this regard, in profiling in the sense of the invention it may be provided that by means of suitable material removing tools a decorative and/or functional profile is introduced at least in a part of the edges of the decorative panel. Herein, a functional profile, for example, means the introduction of a groove and/or tongue profile in an edge in order to make decorative panels connectable to each other by means of the introduced profiles. In particular with groove and/or tongue profiles elastic materials are advantageous because by these alone profiles can be produced which are particularly easy to handle and stable. Thus, in particular no additional materials are needed to produce the connecting elements.

The method described above enables the production of a panel comprising a carrier having a particularly designed and smooth surface. This may in particular be of advantage for the application of further layers onto the carrier such as a decorative subsurface or a top layer in particular by use of a direct printing process.

In particular, the carrier material may be selected arbitrarily and in particular carrier materials may be used which may have particularly advantageous properties for the panel to be produced. For example, particularly high quality panels may be produced which can satisfy the highest requirements regarding appearance and stability. Thus, a production can be particularly effective and cost-efficient.

The method applicable to the method for producing a wall and a floor panel for producing a carrier may be advantageous in particular in the context of the present method according to the disclosure for producing wall and floor panels, since it allows particularly high line speeds well in excess of the line speeds known from the prior art as a feed rate of the carrier or of the conveying means for the production of a panel. Herein, by use of a twin belt press line speeds of up to 15 m/min can be achieved, wherein values of 6 m/min or more may be possible even for materials which are problematic in this regard.

Moreover, by means of the above described two-stage compression process a very precise thickness in particular for carrier materials of panels can be achieved, wherein for example thickness tolerances in a range of 0.1 mm or less can be achieved. Thus, a carrier produced by the method described above in addition to a particularly homogeneous composition further may comprise a particularly uniform thickness, which enables a particularly defined and reproducible product and thus a particularly high quality.

This quality can be further increased by means of a further method step f) subsequently to a first treatment of the carrier in the twin belt press according to method step e). However, this treatment step aims less toward a compression but rather toward a targeted smoothing of the surface. In this way not only the thickness of the carrier but also its surface properties can be adjusted targeted which can lead to a particularly high-quality product.

In a preferred embodiment, it can be provided that the method steps e) and (f) are carried out in a common twin belt press. In this embodiment the method steps e) and f) can thus be carried out in a common pressing device which may lead to a particularly cost-efficient equipment of a plant for carrying out the method of this embodiment. Herein, tempering means may be arranged and act in such a way that within the twin belt press two different temperature stages in particular in different temperature regions of the twin belt press disposed in succession in the advancing direction of the carrier are adjustable in such a way that the carrier may first be treated at the temperature T1 and then at the temperature T2. In this embodiment the different compression factors K1 and K2 thus can be achieved in particular by setting the corresponding temperatures in different treatment areas or temperature areas of the twin belt press. Furthermore, however, it is also possible that the pressing device or the twin belt press has a variable pressing profile such as in a range beginning with 6 mm and ending with 4.1 mm, for example beginning with 5.9 mm and ending with 5.3 mm, e.g. with intermediate stages of 5.7 mm and 5.5 mm. As a result, different compression factors K1 and K2 can be achieved likewise.

Alternatively, it can be provided that the method steps e) and f) are carried out in two separate pressing devices. This enables in particular a modular design and therefore a particularly good adaptability since the pressing devices used in the respective method steps may be adjustable optimally to the prevailing conditions and to the respective desired effect. In particular, the pressing means, such as the components which directly contact the carrier may be adapted to the respective conditions, such as in particular the set temperature and contact pressure.

In addition, the temperatures T1 and T2 can be adjustable in a particularly defined manner, since an interaction of the tempering means with a respective other region, i.e. an influence of the tempering means acting on the temperature T1 on the region to be adjusted with the temperature T2, or vice versa, can be further reduced or completely excluded.

Thus, the compression factors K1 and K2 in this embodiment can in particular be adjusted by setting the respective temperature and the respective contact pressure.

In particular in this embodiment it can be provided that the carrier is stored between the method steps e) and f) and after method step e) and prior to method step f) an intermediate product is produced which, for example, starting with method step f) can be further processed into the finished panel. Thereby a high product variability may be achieved since the intermediate products, for example, can be tailored for various products with respect to the smoothness of the surface of the carrier.

For example, it can be provided that method step f) is carried out in a twin belt press or in a calender. In particular by such pressing means an advantageous smoothing can be achieved. Herein, by means of the twin belt press in particular a long treatment gap can be obtained by which an equally long treatment time of the carrier is enabled. This allows the production of a particularly smooth surface. On the other hand, using a calender enables in a particularly easy way that even at comparatively low temperatures a sufficient influence is exerted onto the carrier.

For example, when using a twin belt press this may include in particular a metal belt, such as a steel belt, in method step f) in order to enable a suitable contact pressure even at the selected temperature range. In method step e) a plastic belt may be sufficient due to the comparatively higher temperature. In this case, the plastic belt and/or the steel belt may be provided with corresponding coatings, for example including polytetrafluoroethylene in order to keep the adhesion to the carrier as small as possible and to enable a particular high stability.

According to a further embodiment a carrier material based on a plastic or a wood plastic composite material (WPC) can be provided. For example, the carrier plate can be formed from a thermoplastic, elastomeric or duroplastic plastic material. In addition, recycling materials from the abovementioned materials can be used in the context of the method according to the invention. Here, as a plate material such as in connection with a WPC material or a pure plastic material in particular thermoplastic plastics, such as polyvinyl chloride (PVC), polyolefins (for example polyethylene (PE), polypropylene (PP), polyamides (PA), polyurethanes (PU), polystyrene (PS), acrylonitrile-butadiene-styrene (ABS), polymethyl methacrylate (PMMA), polycarbonate (PC), polyethylene terephthalate (PET), polyetheretherketone (PEEK)) or mixtures or co-polymers thereof may be preferred.

In this case, irrespective of the base material of the carrier, for example, plasticizers may be present in a range of >0 wt.-% to ≤20 wt.-%, in particular ≤10 wt.-%, preferably ≤7 wt.-%, for example in a range of ≥5 wt.-% to ≤10 wt.-%. A suitable plasticizer comprises for example the plasticizer sold under the trade name "Dinsch" by the company BASF. Further as a substituent for conventional plasticizers copolymers such as acrylates or methacrylates may be provided. Moreover, within or upstream of the twin belt press in this embodiment the carrier can be cooled down to a temperature below the melting point of the plastic component.

In particular, thermoplastics offer the advantage that the products made from them can be easily recycled. It is also possible to use recycling materials from other sources. This offers a further possibility to reduce the manufacturing costs.

Such carriers are very elastic or resilient which allows a comfortable feeling when walking and also enables to reduce the noise occurring during walking compared to conventional materials so that an improved footstep sound insulation can be realized.

In addition, the aforementioned carriers offer the advantage of good water resistance, because they have a degree of swelling of 1% or less. This in a surprising way besides pure plastic carriers also applies to WPC materials, as is explained in detail below.

For a pure plastic carrier, for example, polyvinylchloride may be of advantage.

In a particularly advantageous manner the carrier material may comprise wood-polymer materials (Wood Plastic Composite, WPC) or consist thereof. Here, as an example a wooden material and a polymer may be suitable, which may be present in a ratio of 40/60 to 70/30, such as 50/50. As polymeric components polypropylene, polyethylene or a copolymer of the two aforementioned materials can be used, wherein further wood flour may be used as a wooden component. Such materials offer the advantage that they can be already formed to a carrier at low temperatures, such as in a range of ≥180° C. to ≤200° C., in the method described above such that a particularly effective process control with exemplary line speeds in a range of 6 m/min is enabled. For example, for a WPC product with a ratio of 50/50 of the wooden material and the polymer components an exemplary product thickness of 4.1 mm is possible, which allows a particularly effective manufacturing process.

Further, in this way very stable panels can be produced which moreover have a high elasticity which may in particular be advantageous for an effective and cost-efficient configuration of connecting elements at the edge region of the carrier and further with respect to a footstep sound insulation. Furthermore, the aforementioned good water tolerance with a degree of swelling of less than 1% is enabled in such WPC materials. Herein, WPC materials may, for example, comprise stabilizers and/or other additives which preferably may be present in the plastic component.

Furthermore, it may be particularly advantageous that the carrier material comprises a PVC-based material or consists of PVC. Even such materials can be used in a particularly advantageous manner for high quality panels that may be used even in wet rooms without any problems. Furthermore, also PVC-based carrier materials offer themselves for a particularly effective manufacturing process, since here line speeds of 8 m/min at an exemplary product thickness of 4.1 mm are possible, which enables a particularly effective manufacturing process. Moreover, even such carriers have an advantageous elasticity and water tolerance which can lead to the aforementioned advantages.

For plastic-based panels, such as based on polyvinylchloride, as well as in WPC-based panels, such as based on polypropylene and/or polyethylene, mineral fillers may be of advantage. Here, talcum or talc or calcium carbonate (chalk), aluminum oxide, silica gel, silica flour, wood flour and gypsum are particularly suitable. The amount of mineral fillers, such as talcum, may be in a range of ≥30 wt.-% to ≤80 wt.-%, such as from ≥45 wt.-% to ≤70 wt.-%. By means of fillers, in particular by means of chalk, the slip of the carrier can be improved. With the use of talcum, for example, an improved heat resistance and moisture resistance may be achieved. Moreover, the mineral fillers may be colored in a known manner. For example, a mixture of talcum and polypropylene may be provided in which talcum is present in the abovementioned amount range such as at 60 wt.-%. In particular, it can be provided that the plate material comprises a flame retardant.

According to a particularly preferred embodiment of the invention the carrier material consists of a mixture of a PE/PP block copolymer and wood. Herein, the proportion of the PE/PP block copolymer and the proportion of wood can range between ≥45 wt.-% and ≤55 wt.-%. Furthermore, the carrier material can comprise between ≥0 wt.-% and ≤10 wt.-% of other additives such as flow agents, heat stabilizers or UV stabilizers. Here, the particle size of the wood is between >0 μm and ≤600 μm with a preferred particle size distribution of D50≥400 μm. In particular, the carrier material may comprise wood with a particle size distribution of D10≥400 μm. The particle size distribution is based on the volumetric diameter and refers to the volume of the particles. Particularly preferably the carrier material is provided as granular or pelletized pre-extruded mixture of a PE/PP block copolymer and wood particles with the specified particle size distribution. Here, the granules and/or pellets can preferably have a particle size in the range of ≥400 μm to ≤10 mm, preferably ≥600 μm to ≤10 mm, in particular ≥800 μm to ≤10 mm.

For example, the carrier material may be present in the form of granules and may have a cylindrical shape. Moreover, irrespective of the shape the granule particles, for example in the cylindrical shape, the particles may have a diameter in the range of 2-3 mm, such as 2 or 3 mm, and a length of 2-9 mm, such as 2-7 mm or 5-9 mm.

According to a further preferred embodiment of the disclosure the carrier material consists of a mixture of a PE/PP polymer blend and wood. Here, the proportion of PE/PP polymer blend as well as the proportion of wood can be in a range between ≥45 wt.-% and ≤55 wt.-%. Furthermore, the carrier material can comprise between ≥0 wt.-% and ≤10 wt.-% of other additives such as flow agents, heat stabilizers or UV stabilizers. Here, the particle size of the wood is between >0 μm and ≤600 μm with a preferred particle size distribution of D50≥400 μm. In particular, the carrier material may comprise wood with a particle size distribution of D10≥400 μm. The particle size distribution is based on the volumetric diameter and refers to the volume of the particles. Particularly preferably, the carrier material is provided as a granular or pelletized pre-extruded mixture of a PE/PP polymer blend and wood particles with the specified particle size distribution. Here, the granules and/or pellets can preferably have a particle size in a range of ≥400 μm to ≤10 mm, preferably ≥600 μm to ≤10 mm, in particular ≥800 μm to ≤10 mm.

In a further embodiment of the disclosure the carrier material consists of a mixture of a PP homopolymer and wood. The proportion of the PP homopolymer and the proportion of wood can be in a range between ≥45 wt.-% and ≤55 wt.-%. For example, the constituents wood and polypropylene may be present in a ratio of 0.5:1 to 1:0.5, such as 1:1. Furthermore, the carrier material can comprise between ≥0 wt.-% and ≤10 wt.-% of other additives, such as flow agents, heat stabilizers or UV stabilizers. Here, the particle size of the wood is between >0 μm and ≤600 μm with a preferred particle size distribution of D50≥400 μm. In particular, the carrier material can comprise wood with a particle size distribution of D10≥400 μm. The particle size distribution is based on the volumetric diameter and refers to the volume of the particles. Particularly preferably the carrier material is provided as a granular or pelletized pre-extruded mixture of a PP homopolymer and wood particles of the specified particle size distribution. The granules and/or pellets can preferably have a particle size in the range of ≥400 μm to ≤10 mm, preferably ≥600 μm to ≤10 mm, in particular ≥800 μm to ≤10 mm.

In another embodiment of the disclosure the carrier material consists of a mixture of a PVC polymer and chalk. Herein, the proportion of the PVC polymer and the proportion of chalk can be in a range between ≥45 wt.-% and ≤55 wt.-%. Furthermore, the carrier material can comprise between ≥0 wt.-% and ≤10 wt.-% of other additives, such as flow agents, heat stabilizers or UV stabilizers. The particle size of the chalk is between >0 μm and ≤1000 μm, for example between ≥800 μm and ≤1000 μm, with a preferred particle size distribution of D50≥400 μm, for example ≥600 μm. In particular, the carrier material may comprise chalk with a particle size distribution of D10≥400 μm, for example ≥600 μm. The particle size distribution is based on the volumetric diameter and refers to the volume of the particles. Particularly preferably the carrier material is provided as a granular or pelletized pre-extruded mixture of a PVC polymer with chalk with the specified particle size distribution. The granules and/or pellets can preferably have a particle size in the range of ≥400 μm to ≤10 mm, preferably ≥600 μm to ≤10 mm, in particular ≥800 μm to ≤10 mm, such as ≥1000 μm to ≤10 mm.

In a further embodiment of the disclosure the carrier material consists of a mixture of PVC polymer and wood. Herein, the proportion of the PVC polymer and the proportion of the wood can be in a range between ≥45 wt.-% and ≤55 wt.-%. Furthermore, the carrier material can comprise between ≥0 wt.-% and ≤10 wt.-% of other additives, such as flow agents, heat stabilizers or UV stabilizers. The particle size of the wood is between >0 μm and ≤1000 μm, such as between ≥800 μm and ≤1000 μm, with a preferred particle size distribution of D50≥400 μm, such as ≥600 μm. In particular, the carrier material can comprise wood with a particle size distribution of D10≥400 μm, such as ≥600 μm. The particle size distribution is based on the volumetric diameter and refers to the volume of the particles. Particularly preferably the carrier material is provided as granular or pelletized pre-extruded mixture of a PVC polymer and wood particles of the specified particle size distribution. The granules and/or pellets can preferably have a particle size in the range of ≥400 μm to ≤10 mm, preferably ≥600 μm to ≤10 mm, in particular ≥800 μm to ≤10 mm, such as ≥1000 μm to ≤10 mm.

For determining the particle size distribution well-known methods such as laser diffractometry can be used, by means of which particle sizes in the range from a few nanometers up to several millimeters can be determined. Using this method also D50 or D10 values can be determined, according to which 50% and 10%, respectively, of the measured particles are smaller than the specified value.

In a further preferred embodiment, it can be provided that the carrier between the method steps e) and f) is cooled down to a temperature T3, wherein T3<T1 and wherein T3<T2. In other words, the carrier is in particular completely cooled down first to a temperature T3 which is below the processing temperature T1 which is used in method step e) and which is also below the processing temperature T2 which is used in method step f). For example, the temperature T3 can be in a range from 30° C. to 100° C., for example ≥40° C. to ≤90° C., such as ≥60° C. to ≤70° C. The cooling process can advantageously be realized stepwise, i.e. the temperature is not reduced continuously but stepwise. For example, a three-step cooling process can be carried out, wherein the temperature in no way limiting is cooled down, for example, to a range from ≥75° C. to ≤100° C., for example 90° C., then to a range from ≥50° C. to ≤74° C., for example 60° C., and then to a range from ≥30° C. to ≤49° C., for example 40° C. The stepwise cooling may include that the carrier is held in the mentioned temperature ranges and/or at a constant temperature for a defined time duration.

This embodiment can be particularly preferred, for example, if the carrier is stored temporarily between the method steps e) and f) since in this case a stacking of the carrier with cooled down temperature can be significantly more gentle and the carrier can be more stable with a comparatively low temperature than with a comparatively higher temperature. In this case, in particular, a stepped cooling process can be of advantage, since in this way a deformation of the carrier can be further reduced or completely prevented.

As to the cooling process it can be effected by means of a cooling circuit which in particular in combination with the other passages for cooling the carrier can be realized as a closed cooling circuit.

In a further preferred embodiment it may be provided that the carrier prior to or at method step f) is heated to a temperature which is above the crystallization temperature of a plastic present in the carrier. In particular in this embodiment a surface having a high degree smoothness can be formed. Moreover, the properties of the carrier can be further improved. For example, the carrier may have improved stability properties, in particular with respect to its mechanical and/or thermal and/or chemical resistance. As a result, the quality of the carrier can be further improved.

In a further preferred embodiment, it may be provided that prior to method step e) an anti-adhesive means is arranged such that at least in the twin belt press it is disposed between the carrier and a conveying means, such as the upper conveying means, preferably between the carrier and both conveying means. In this embodiment, adhesion of the carrier to a conveying means can particularly effective be prevented. The anti-adhesive means may, for example, be rolled up on a first roll and be fed together with the carrier through the twin belt press and optionally the further pressing unit, such as the calender, before being rolled up onto another roll. Preferably there is no relative velocity between the anti-adhesive means and the carrier. In other words, the anti-adhesive means preferably moves with the same velocity as the carrier.

For example, the anti-adhesive means may comprise a release paper, such as an oil paper. An oil paper, also referred to as wax paper, in a known way means for example a wood-free paper which comprises an organic substance, for example an oil or wax or paraffin, for example is impregnated therewith.

As a result, adhesion of the carrier can be prevented in a particularly secure manner, and thereby a particularly high quality product can be obtained.

According to a further embodiment a fiber material may be incorporated into the carrier. In particular, the fiber material can be incorporated into the carrier in method step b). In this embodiment therefore a fiber material, in particular a fiber material web can be wound onto a roll and unwound by an unwinding station for unwinding the fiber material and supplied between the two belt-like conveying means in order to insert the fiber material. For example, in this embodiment a glass fiber mat can be used. In this embodiment a carrier with a particularly high strength or stability can be produced since the strength of the carrier can be increased significantly by means of the incorporated fiber material. Moreover, in this embodiment the carrier can be particularly tailored, because, for example, by providing a plurality of scattering units, as explained above in detail, the carrier material, for example, can be adjusted above and below the mat or non-woven fabric as desired. Moreover, a solution which enables an even better tailoring can be realized by providing a plurality of fiber material webs, wherein the carrier material again may be varied or adjusted as desired.

According to a further embodiment method step d) may be performed by use of an S-roller. By using an S-roller as a compression unit a desired compression is possible in a defined way with simple and inexpensive means even at high line speeds. In order to be able to set the corresponding and depending on the desired result appropriate force the roller can be shiftable, for example, in the direction to the passing carrier material. Herein, the S-roller may, for example, comprise only a single roller, which exerts a force only in combination with a counter-force generated by the belt tension of the conveying means. Alternatively, one or a plurality of counter rollers may be provided, which apply the corresponding counter force.

An S-roller in the sense of the invention means a roller which is arranged such that the carrier passes it in an S-shaped path as is well known to those skilled in the art and is described in detail below with reference to the figures.

Furthermore, optionally a temperature gradient can be set in the twin belt press. This can be achieved, in particular, by a temperature gradient in a direction perpendicular to the conveying direction. In this embodiment, a particularly high line speed can be allowed since a particularly fast heating can be achieved which allows a high line speed. Herein, moreover, an excessively high temperature effect on the carrier material can be prevented which can prevent damages and enable a particularly high quality. In addition, degassing upon heating of the carrier material can be improved and accelerated which in turn allows a high line speed and further enables a particularly high stability and quality by preventing gas inclusions. In the latter case, in particular, the region below the carrier material can be heated to a larger extent than the region above the carrier material, i.e. a lower tempering element may have a higher temperature than an upper tempering element. For example, here a temperature gradient in a range of 50° C. can be advantageous.

Regarding further technical features and advantages of the method it is hereby explicitly referred to the description of the apparatus as well as to the figures.

The subject matter of the present disclosure is further an apparatus for carrying out the method as described above. The apparatus comprises

- two endless belt-like conveying means;
- a discharge unit for applying a carrier material between the belt-like conveying means;
- a molding unit for forming a web-shaped carrier from the carrier material;
- a first pressing means for compressing the carrier;
- a twin belt press as a pressing means for treating the carrier under the action of pressure at a temperature T1;
- optionally a further pressing means, wherein the apparatus is further configured such that the carrier after the treatment in the twin belt under the action of pressure at a temperature T1 can be treated further at a temperature T2 in the twin belt press or in the further pressing means such that a compression factor K1 can be set at the temperature T1 and a compression factor K2 can be set at the temperature T2, wherein $K2<K1$.

The apparatus thus serves for the purpose to form a web-shaped carrier from an in particular granular carrier material.

For this purpose two belt-like conveying means are provided, which at first are able to convey the carrier material or in the course of the process the carrier formed therefrom. For example, the conveying means can each form an endless conveying belt such that a processing gap is formed between the upper run of a lower conveying belt and a lower run of an upper conveying belt.

Furthermore, a discharge unit is provided, which is adapted to apply the carrier material between the two conveying means. For example, the discharge unit can scatter the carrier material onto the lower conveying belt as described in detail above.

The apparatus further comprises a molding unit for forming a web-shaped carrier from the carrier material. By means of this molding unit at first a web-shaped carrier is formed from the loose material. The molding unit can, for example, comprise two plate-shaped molding means such as that described above.

In order to compress the web-shaped carrier, moreover, a pressing means is provided. This can, in particular, be an S-roller, as described above with reference to the method.

Subsequently a twin belt press is provided as a pressing means for treating the carrier under the action of pressure at a temperature T1. By use of the twin belt press the carrier can be compressed at the temperature T1 by applying a pressure in such a way, that the carrier is compressed while forming a compression factor K1.

Optionally a further pressing means can be arranged downstream of the twin belt press in the transport direction of the carrier. Either in this further pressing means or in the twin belt press the carrier is treated at a temperature T2, wherein a compression with a compression factor K2 which is lower than K1 is achieved. Thus, the treatment of the carrier at the temperature T2 substantially only contributes little to a compression but rather to a smoothing of the corresponding carrier surface, if appropriate.

This can, for example, be realized in such a way that in the twin belt press itself two different temperature ranges are present, for example by the provision of tempering means arranged in succession in the transport direction of the carrier or by an additional pressing means which is adapted to set a temperature which is lower than that of the twin belt press and a contact pressure which is different from that of the twin belt press.

With regard to further technical features and advantages of the apparatus it is herein explicitly referred to the description of the method, as well as to the figures.

Hereinafter the disclosure is further described with reference to the figures and an exemplary embodiment.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
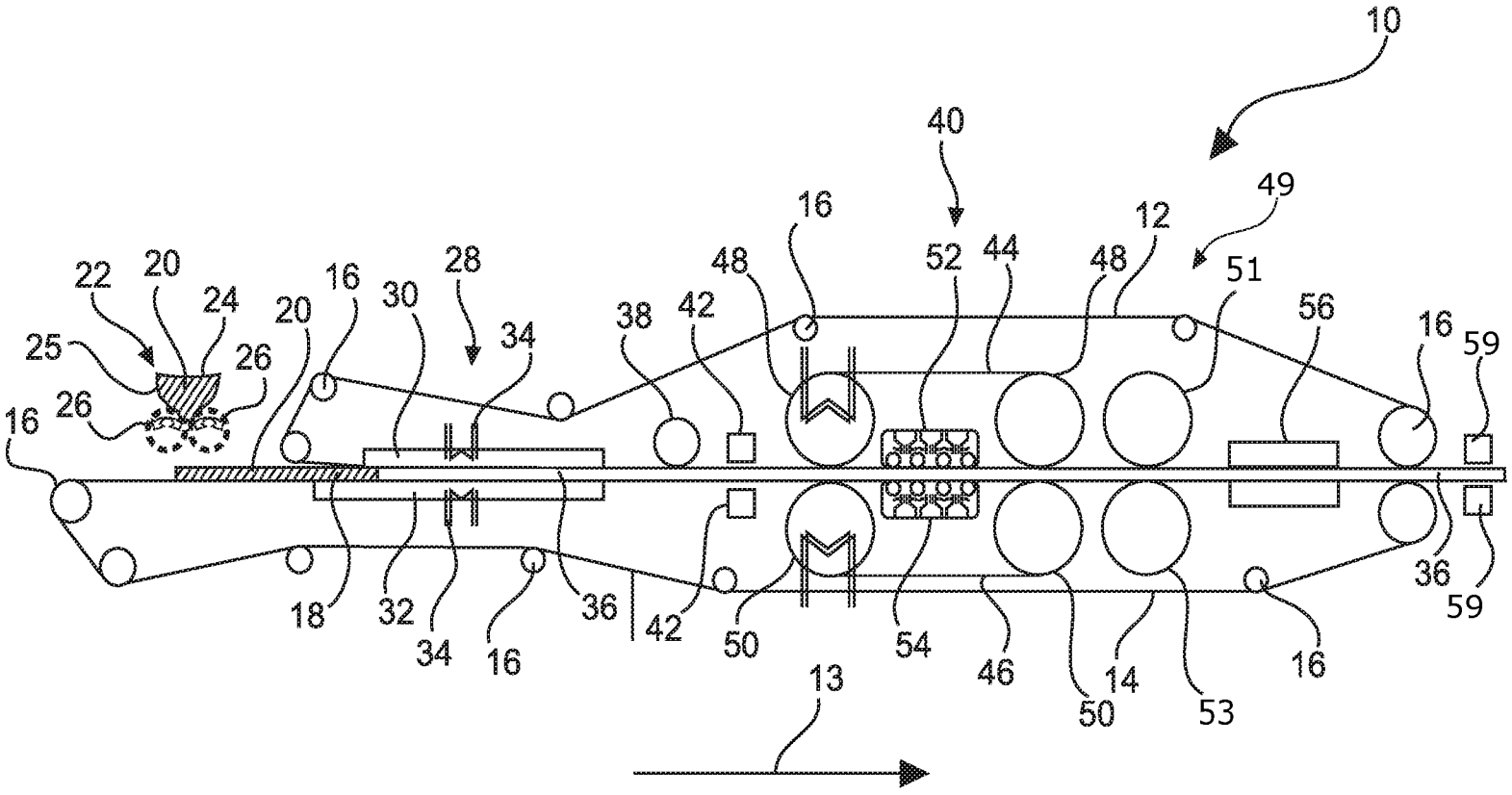
Figure 3:
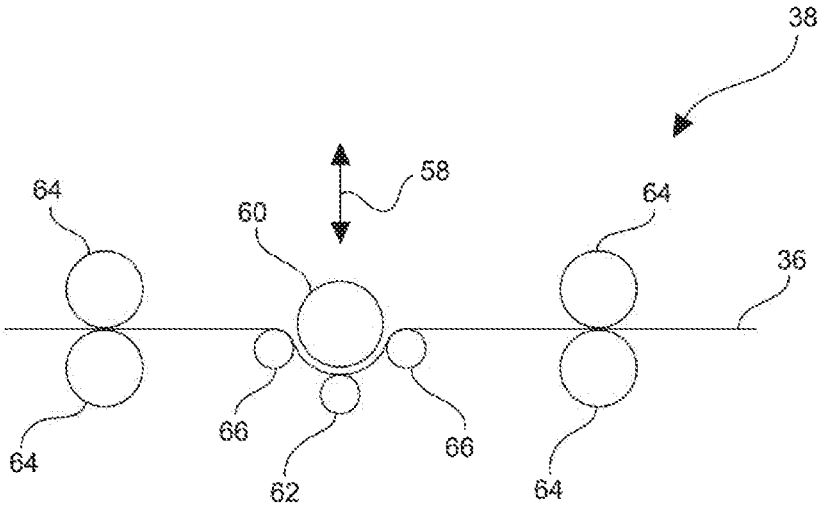

FIG. 1 schematically shows an embodiment of an apparatus according to the disclosure for carrying out a part of the method according to the invention;

FIG. 2 schematically shows an embodiment of a further apparatus according to the disclosure for carrying out a part of the method according to the disclosure; and FIG. 3 shows an exemplary S-roller for carrying out a method step of the method according to the disclosure.

Corresponding reference numerals indicate corresponding parts throughout the several views of the drawings.

DETAILED DESCRIPTION

Example embodiments will now be described more fully with reference to the accompanying drawings.

The apparatus according to FIG. 1 is suitable for a method for producing a decorated wall or floor panel. Here, with respect to FIG. 1 in particular processing stations for the following method steps are described:

a) providing a pourable carrier material 20, in particular granules;
b) arranging the carrier material 20 between two belt-like conveying means 12, 14;
c) molding the carrier material 20 under the influence of temperature while forming a web-shaped carrier 36;
d) compressing the carrier 36;
e) treating the carrier 36 under the action of pressure by use of a twin belt press, wherein the carrier is cooled prior to or within the twin belt press at a temperature T1 while forming a compression factor K1 of the carrier;
f) treating the carrier 36 under the action of pressure at a temperature T2 while forming a compression factor K2 of the carrier 36, wherein $T2<T1$ and wherein $K2<K1$;
g) cooling the carrier 36, if necessary.

Following these method steps the method may comprise further method steps in order to obtain the finished wall or floor panel.

The apparatus 10 according to FIG. 1 comprises two endless belt-like conveying means 12, 14, which are guided in particular by deflection rollers 16 in such a way that between them a receiving space 18 or processing gap for receiving and processing a provided pourable, in particular granular carrier material 20, for example on the basis of a plastic, e.g. PVC, or a wood-plastic composite material, e.g. wood and PP, PE or a block copolymer comprising PP and PE or based on an HDF material based on PVC is formed. The conveying means 12, 14 can be at least partially made of polytetrafluoroethylene, for example coated therewith. Moreover, the conveying means 12, 14 can at least partially be roughened or structured in particular on their side facing the receiving space 18. Moreover, the conveying means 12, 14 may have a width in a range of about 1.5 m.

In order to apply the carrier material 20 between the belt-like conveying means 12, 14 or in the receiving space 18, a discharge unit 22 with one or a plurality of discharge heads 24 is provided, by means of which the carrier material 20 can be placed on the lower conveying means 14. The discharge heads 24 can comprise a funnel 25 which applies the carrier material 20 onto corresponding scattering rollers 26, whereupon the carrier material 20 can be scattered onto the lower conveying means 14.

In order to ensure a homogeneous application of the carrier material 20 onto the lower conveying means 14 a sensor for checking the placement of the carrier material 20 between two belt-like conveying means 12, 14 may be provided. The sensor can in particular be coupled with the discharge unit 22 in order to avoid a potentially inaccurate filling of the accommodating space 18.

In order to enable a particularly homogeneous distribution of the carrier material 20, vibrators may be provided. These may, for example, act on the lower conveying means 14 and may be arranged, for example, below the lower conveying means 14, such that the carrier material 20 is finely distributed.

In order to prevent unwanted contamination and a damage of downstream processing stations, moreover a sensor for detecting metals can be provided, which is able to detect inadvertently introduced metal.

Furthermore, a device for introducing a fiber material into the receiving space 18 and thus into the carrier may be provided. For example, the fiber material may be configured band-like and be unwound from a roll. Herein, the fiber material can be disposed between two discharge heads 24 in order to be able to dispose different materials above and below the fiber material. Thus, the fiber material can be introduced, for example, in such a way that above and below the fiber material a desired quantity of carrier material 20 is disposed.

In the conveying direction of the conveying means 12, 14, which is indicated by the arrow 13, a molding unit 28 is provided which is configured to mold the carrier material 20 under the action of temperature or heat in order to melt the carrier material 20 while forming a web-shaped or web-like carrier 36. For this purpose, the molding unit 28 may comprise two plate-like molding means 30, 32 which can be heated by one or two heaters 34, for example by means of a thermal oil. In this way the carrier material 20 can be heated until, depending on the melting point of the carrier material 20 or a portion thereof, it has reached a temperature of, for example, ≥180° C. to ≤200° C. depending on the material used, such as PVC or a WPV material. For this purpose, the molding unit 28 or the molding means 30, 32 can, for example, be heated to a temperature of up to 250° C. In this case, for example, one or, for setting a temperature gradient, a plurality of independently adjustable heating areas may be provided. For example, the entire molding means 30, 32 which may have a length of several meters, may be heatable, or only a portion thereof may be heatable.

Furthermore, the molding unit 28 can, in particular, comprise a parallel gap, which may be formed by the plate-like molding means 30, 32. Herein, however, at the inlet an inlet channel may be provided in a conical shape in order to enable an improved inflow of the carrier material 20. The force acting on the carrier material 20 can be in a range of $>0$ kg/m$^2$ to $\leq 1$ kg/m$^2$. In particular, a uniform pressurization without the provision of a pressure profile or a pressure gradient may be provided.

Furthermore, it can be seen in FIG. 1 that the lower molding means 32 is longer than the upper molding means 30 and also starts upstream of the upper one. As a result, it can be achieved that a processing is not carried out until the carrier material 20 and optionally the film material is already melted or at least partially melted and at least partially softened. As a result, a particularly defined molding process can be achieved.

In the further course in the conveying direction of the conveying units 12, 14, the web-like carrier 36 is fed through a pressing means 38. The pressing means 38 can, for example, include an S-roller, which is shown in detail in FIG. 3. The S-roller may be displaceable substantially perpendicular to the surface of the carrier 36 and thus to the direction of displacement of the carrier 36, as indicated by the arrow 58, so that the desired pressures can be particularly advantageously be adjustable. Furthermore, the pressing means 38 can for example apply a pressure onto the carrier 36 in a range of ≥1 kg/m$^2$ to ≤3 kg/m$^2$. The S-roller comprises a main roller 60 which acts on the web-shaped carrier 36. Here the belt tension may be sufficient as counter-pressure, however, it is preferred that at least one counter-pressure roller 62 is provided. For a suitable guidance of the web-like carrier 36, moreover, two pairs of calender rollers 64 and optionally deflection rollers 66 may be provided which may provide a suitable belt tension. In FIG. 2 it can be seen that the web-like carrier 36 is fed twice in an S-shaped manner around the deflection rollers 66 and the main roller 60, and it is this type of guidance that specifies the term S-roller. In detail, the main roller 60 can be wrapped by the web-shaped carrier 36 in a range of approximately 50% or more. The temperature of the carrier 36 at the entry into the pressing means 38 corresponds in particular to the temperature present at the exit from the molding unit 28.

Irrespective of the specific embodiment of the pressing means 38 or the apparatus 10 the pressing means 38 can be operated at a temperature which is in a range from ≥130° C. to ≤200° C., approximately in a range from ≥160° C. to ≤200° C., for example 180° C.

From the pressing means 38 the carrier 36 is subsequently fed to a further pressing means 40. In order to compensate any heat loss of the carrier 36 or to intentionally heat the carrier 36 further or to actively cool the carrier 36 a further tempering means 42 such as a heating means, for example an IR heater, or preferably a cooling means for cooling the carrier 36 can be arranged between the pressing means 38, 40. Herein, the carrier 36 can also be cooled by a heating means provided that it transmits a temperature to the carrier which is below the carrier temperature present before the entry into the tempering means 42, but above room temperature.

Returning to the pressing means 40, this can advantageously be a twin belt press which in particular may comprise belts 44, 46, such as steel belts or else plastic belts which, for example, may be coated with polytetrafluoroethylene (Teflon) on the side facing the carrier 36, and wherein the belts 44, 46 of the twin belt press may be guided by deflection rollers 48, 50. The deflection rollers 48, 50 can, for example, be heated or advantageously cooled, for example by means of a thermal oil tempering and/or the rollers on the same side of the gap may be disposed at a distance in a range from ≥1 m to ≤2 m, for example 1.5 m, from each other, wherein the belts 44, 46 may have a width in a range of about 1.5 m. According to FIG. 1, the carrier 36 disposed between the conveying means 12, 14 is guided between the deflection rollers 48, 50 and thus between the belts 44, 46, such as in particular steel belts. On the side of the belts 44, 46 opposite to the carrier 36 respective pressing and/or tempering means 52, 54 are provided by means of which the carrier 36 can be cooled and, if necessary, heated. These can heat, cool and slightly compress the conveying means 12, 14 and thus the carrier 36. For this purpose, for example, an air cooling system may be provided and a plurality of rollers which can allow intermittent pressing.

The tempering means 52, 54 can set a temperature T1 of the carrier 36 which is in the range from ≥150° C. to ≤190° C., for example from ≥160° C. to ≤180° C., such as 170° C. At a corresponding pressing pressure, thus, a compression factor K1 of the carrier in a range of ≥0.1 to ≤0.3, for example ≥0.15 to ≤0.25, is achieved such that the thickness at the abovementioned compression factors, for example, decreases by a value which is in a range of ≥10% to ≤30%, in particular ≥15% to ≤25%, such as 20%.

Furthermore, the further tempering means 55, 57 can set a temperature T2 of the carrier 36 which is in a range of ≥100° C. to ≤150° C., such as 120° C. At a corresponding pressing pressure, thus, a compression factor K2 of the carrier in a range of >0 to ≤0.2, for example >0.03 to ≤0.15, such as ≥0.05 to ≤0.12, exemplarily at 0.1, is achieved such that the thickness at the abovementioned compression factors, for example, decreases by a value which is in a range of ≥3% to ≤15%, in particular ≥5% to ≤12%, such as 10%.

The tempering means 52, 54, 55, 57 for setting the temperature T1 and/or T2 can, for example, be designed as NIR radiators or can be fed by or comprise a heating circuit.

This allows different temperature zones to be set in the twin belt press such that the carrier 36 is first compressed at the temperature T1 with a compression factor K1, and wherein the carrier 36 is further compressed at the temperature T2 with a compression factor K2, wherein K1<K2. As a result, the surface of the carrier, in particular the upper surface, is substantially not significantly compressed but rather smoothed.

The same can be realized, as shown in FIG. 2, by providing a further pressing unit 49 in the advancing direction of the carrier 36. For this purpose, a further twin belt press can be provided, or, as shown in FIG. 2, a calender with the calender rollers 51, 53 may be provided in order to smoothen the carrier 36 or its surface.

A cooling means 56 can be arranged downstream of the pressing means 40 in the conveying direction by means of which the carrier 36 can be cooled down to a temperature in a range of ≤350° C. In this case, the cooling means 56 can, for example, be based on water cooling and may have several cooling zones in order to enable a defined cooling by use of precisely adaptable cooling programs. The length of the cooling zone may correspond to the effective length of the pressing means 40. Downstream of the cooling means 56 there may be provided yet another cooling belt.

Following these method steps the carrier 36 which may have a final thickness in a range from ≥3 mm to ≤5 mm, such as 4.1 mm, can immediately be further treated or stored, for example as a web-shaped carrier 36 or as an already separated plate-shaped carrier.

Furthermore, in the traveling direction of the carrier 36 downstream of the rolls 16 at least one heating means 59 or two heating means 59 can be provided which may be arranged above and possibly below the carrier 36 and by means of which the carrier 36 can be heated. As a result, it is possible to heat the carrier 36 after method step f) to a temperature which is above the crystallization temperature of a plastic component included in the carrier 36, wherein a cooling process may follow.

For example following the processings in the pressing means 40 or the heating means 57 the further method steps are carried out in the method according to the disclosure:

g) optionally applying a decorative subsurface onto at least a portion of the carrier 36;

h) applying a decoration reproducing a decorative template onto at least a portion of the carrier 36;

i) applying a protective layer onto at least a portion of the decoration;

j) optionally structuring the protective layer; and k) optionally treating the carrier 36 for electrostatic discharge prior to one of the abovementioned method steps.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A method for producing a decorated wall or floor panel, comprising the method steps:

a) providing a pourable carrier material;

b) placing the carrier material between two belt conveying means;

c) forming the carrier material under the action of temperature while forming a carrier sheet;

d) compressing the carrier;

e) treating the carrier under the action of pressure by use of a twin belt press at a temperature T1 while reducing the thickness of the carrier by compression factor K1;

f) subsequently treating the carrier under the action of pressure at a temperature T2 while reducing the thickness of the carrier by a compression factor K2, wherein $T2<T1$, and wherein $K2<K1$, wherein T1 is in a range of between ≥150° C. and ≤190° C., T2 is in a range between ≥100° C. and ≤150° C., K1 is in a range between >0 and ≤0.3, and K2 is in a range between >0 and ≤0.2;

g) optionally cooling the carrier;

h) optionally applying a decorative subsurface onto at least a portion of the carrier;

i) applying a decoration reproducing a decorative template onto at least a portion of the carrier; and j) applying a protective layer onto at least a portion of the decoration.

2. The method according to claim 1, wherein the temperature T1 and the temperature T2 are set by tempering means acting separate from each other.

3. The method according to claim 1, wherein the method steps e) and f) are carried out in a common twin belt press.

4. The method according to claim 1, wherein the method steps e) and f) are carried out in two pressing means separated from each other.

5. The method according to claim 4, wherein the method step f) is carried out in a twin belt press or in a calender.

6. The method according to claim 1, wherein a carrier material based on a plastic or a wood-plastic composite material is provided.

7. The method according to claim 1, wherein the carrier is temporarily stored between method steps e) and f).

8. The method according to claim 1, wherein the carrier is cooled down to a temperature T3 between method steps e) and f), wherein $T3<T1$ and wherein $T3<T2$.

9. The method according to claim 1, wherein the carrier prior or subsequently to method step f) is heated to a temperature which is above the crystallization temperature of a plastic component present in the carrier.

10. The method according to claim 1, wherein prior to method step e) an anti-adhesive means is disposed such that at least within the twin belt press it is disposed between the carrier and the conveying means.

11. The method according to claim 1, wherein the carrier is cooled prior to method step e) in particular below the melting point or the softening point of a plastic component of the carrier.

12. The method according to claim 1, wherein the carrier subsequently to method step f) is heated to a temperature above the crystallization temperature of a plastic present in the carrier.

13. The method according to claim 1, wherein method step f) is carried out in a twin belt press, wherein belt conveying means used in method step f) each comprise a steel belt coated with polytetrafluoroethylene.

14. The method according to claim 1, wherein a method step d) is carried out by use of an S-roller.

15. An apparatus for carrying out a method according to claim 1, comprising;

two endless belt conveying means;

a discharge unit for applying a carrier material between the belt conveying means;

a molding unit for forming a carrier sheet from the carrier material;

a first pressing means for compressing the carrier;

a twin belt press as a pressing means for treating the carrier under the action of pressure at a temperature T1;

optionally a further pressing means, wherein the apparatus is further configured such that the carrier after the treatment in the twin belt under the action of pressure at a temperature T1 can be treated further at a temperature T2 in the twin belt press or in the further pressing means such that a compression factor K1 can be set at the temperature T1 and a compression factor K2 can be set at the temperature T2, wherein $K2<K1$, wherein T1 can be set in a range of between ≥150° C. and ≤190° C., T2 can be set in a range between ≥100° C. and ≤150° C., K1 can be set in a range between >0 and ≤0.3, and K2 can be set in a range between >0 and ≤0.2.

* * * * *